US009993857B2

(12) United States Patent
Schneider et al.

(10) Patent No.: US 9,993,857 B2
(45) Date of Patent: Jun. 12, 2018

(54) METHOD FOR PRODUCING A SHEET METAL PROFILE FOR A DRAWER PULL-OUT GUIDE AND SHEET METAL PROFILE PRODUCED THEREBY AND DRAWER PULL-OUT GUIDE PRODUCED THEREBY

(71) Applicant: Julius Blum GmbH, Hoechst (AT)

(72) Inventors: Martin Schneider, Hard (AT); Olaf Isele, Lustenau (AT)

(73) Assignee: Julius Blum GmbH, Hoechst (AT)

( * ) Notice: Subject to any disclaimer, the term of this patent is extended or adjusted under 35 U.S.C. 154(b) by 377 days.

(21) Appl. No.: 14/700,638

(22) Filed: Apr. 30, 2015

(65) Prior Publication Data

US 2015/0266070 A1 Sep. 24, 2015

Related U.S. Application Data

(63) Continuation of application No. PCT/AT2013/000181, filed on Nov. 6, 2013.

(30) Foreign Application Priority Data

Nov. 15, 2012 (AT) ..... A 1213/2012

(51) Int. Cl.
*B21B 1/24* (2006.01)
*B21D 5/08* (2006.01)
(Continued)

(52) U.S. Cl.
CPC ..... *B21B 1/24* (2013.01); *A47B 88/40* (2017.01); *A47B 88/487* (2017.01);
(Continued)

(58) Field of Classification Search
CPC ..... B21B 1/092; B21B 1/12; B21B 1/222; B21B 1/24; B21D 5/08
See application file for complete search history.

(56) References Cited

U.S. PATENT DOCUMENTS 4,433,565 A * 2/1984 Preller ..... B21B 1/08 72/177
4,659,237 A 4/1987 Rapp
(Continued)

FOREIGN PATENT DOCUMENTS

CN 102056510 5/2011
DE 100 39 768 2/2002
(Continued)

OTHER PUBLICATIONS

International Search Report (ISR) dated Mar. 19, 2014 in International (PCT) Application No. PCT/AT2013/000181.
(Continued)

*Primary Examiner* — Debra Sullivan
(74) *Attorney, Agent, or Firm* — Wenderoth, Lind & Ponack, L.L.P.

(57) ABSTRACT

A method relates to producing a sheet metal profile, in particular consisting of steel, for a drawer pull-out guide having at least one web projecting laterally, in particular perpendicularly, from a flat surface of the sheet metal profile and extending in the longitudinal direction of the sheet metal profile. In a first method step, from at least one flat surface of a sheet metal billet, there is extruded at least one web projecting laterally, in particular perpendicularly, and extending in the longitudinal direction of the sheet metal billet. In at least one further method step, preferably in 10 to 15 further method steps, the at least one web is squeezed together, i.e. is reduced in width and increased in height. The invention further relates to a sheet metal profile produced in this manner and to a drawer pull-out guide that comprises such a profile.

19 Claims, 8 Drawing Sheets

(51) Int. Cl.

| | |
|---|---|
| ***B21B 27/02*** | (2006.01) |
| ***B21B 35/02*** | (2006.01) |
| ***A47B 88/931*** | (2017.01) |
| ***A47B 88/40*** | (2017.01) |
| ***A47B 88/487*** | (2017.01) |

(52) U.S. Cl.

CPC ..... *A47B 88/931* (2017.01); *B21B 27/02* (2013.01); *B21B 35/02* (2013.01); *B21D 5/08* (2013.01); *Y10T 428/1241* (2015.01)

(56) References Cited

U.S. PATENT DOCUMENTS

| | | | |
|---|---|---|---|
| 2,361,729 | A | 10/1994 | Nedden et al. |
| 5,395,169 | A | 3/1995 | Rock et al. |
| 5,536,083 | A | 7/1996 | Bruestle et al. |

FOREIGN PATENT DOCUMENTS

| | | |
|---|---|---|
| DE | 103 05 542 | 8/2004 |
| EP | 0 613 640 | 9/1994 |
| GB | 2 168 597 | 6/1986 |
| JP | 54-49966 | 4/1979 |
| JP | 57-4301 | 1/1982 |
| JP | 58-135704 | 8/1983 |
| JP | 60-102202 | 6/1985 |
| JP | 60-102205 | 6/1985 |
| JP | 4-66201 | 3/1992 |
| JP | 7-16601 | 1/1995 |
| JP | 8-57503 | 3/1996 |
| JP | 8-117911 | 5/1996 |
| JP | 2008-161935 | 7/2008 |
| JP | 2009-22992 | 2/2009 |
| JP | 2010-149181 | 7/2010 |
| JP | 2012-161842 | 8/2012 |
| WO | 2009/154299 | 12/2009 |

OTHER PUBLICATIONS

Austrian Patent Office Search Report (ASR) dated Jun. 6, 2013 in Austrian Patent Application No. A 1213/2014.

Chinese Search Report dated Mar. 28, 2016, in Chinese Application No. 201380063959.3.

* cited by examiner 3
6
15
10

16
17
9
1
8

7
6
5
11

6
5
12

6
5
13

6
5
14

METHOD FOR PRODUCING A SHEET METAL PROFILE FOR A DRAWER PULL-OUT GUIDE AND SHEET METAL PROFILE PRODUCED THEREBY AND DRAWER PULL-OUT GUIDE PRODUCED THEREBY

BACKGROUND OF THE INVENTION

The invention concerns a method for producing a sheet metal profile, in particular consisting of steel, for a drawer extension guide having at least one web projecting laterally, in particular perpendicularly, from a flat surface of the sheet metal profile and extending in the longitudinal direction of the sheet metal profile. The invention further concerns a sheet metal profile produced by the method, and a drawer extension guide including at least one sheet metal profile produced by the method.

Such a production method—although not explicitly directed to the production of a sheet metal profile for a drawer extension guide—is known by the term "gap profiling", which is the subject-matter of DE 100 39 768 A1. The "gap profiling" method involves using a shaping roll engaging the edge of a piece of sheet metal to shape out of the edge of the piece of sheet metal at least one flange facing away from the plane of the piece of sheet metal and of smaller thickness than the thickness of the initial workpiece. The flange produced in that way can then subsequently be further deformed relative to the initial sheet metal (compare DE 103 05 542 A1).

A disadvantage with the method known from the state of the art is that the flange can only be shaped out of the edge of the sheet metal. Furthermore, the flange is of a thickness which is smaller in comparison with the initial sheet metal. That means that the method is unsuitable for a series of areas of application, for example drawer extension guides.

SUMMARY OF THE INVENTION

The object of the invention is to avoid the above-described disadvantages, and to provide a method which is improved over the state of the art as well as a sheet metal profile produced by that method and a drawer extension guide including at least one such sheet metal profile.

To attain that object, the invention includes a first method step of squeezing out of at least one flat surface of an elongate sheet metal profile at least one web projecting laterally, in particular perpendicularly and extending in the longitudinal direction of the elongate sheet metal portion. The at least one web is squeezed together in at least one further method step, preferably in between 10 and 15 further method steps, and thereby the at least one web is reduced in its width and increased in its height.

In comparison with the state of the art, it is possible by virtue of that method to produce the at least one web in any region of a flat surface of an elongate sheet metal portion, not just in the edge region. Furthermore, depending on how far the at least one web is squeezed together in the further method steps, the web can be made of any desired dimension, so that the parameters of width and height of the web can be adapted to its specific purpose of use.

BRIEF DESCRIPTION OF THE DRAWINGS

Advantageous embodiments of the invention are defined in the appendant claims and are described more fully hereinafter together with further details and advantages of the invention in the context of the following description of the Figures in which:

DETAILED DESCRIPTION OF THE INVENTION

Figure 1:
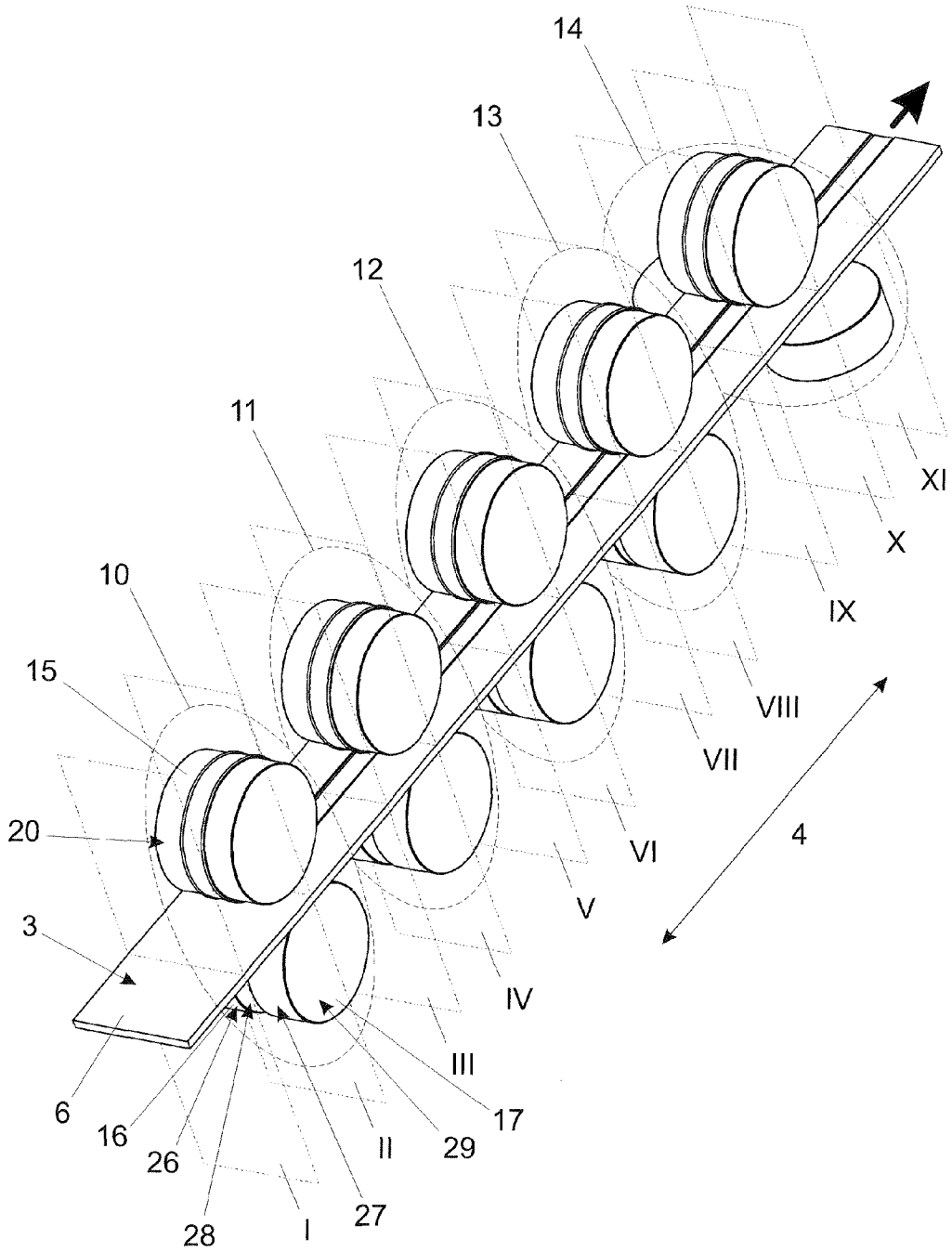
FIG. 1 is a diagrammatic perspective overall view of an embodiment of the production method according to the invention, FIGS. 2*a*) 2*b*), 2*c*), 2*d*), 2*e*), 2*f*), 2*g*), 2*h*), 2*i*), 2*j*), and 2*k*) are schematic diagrams showing a succession of diagrammatically illustrated cross-sectional views of the cross-sectional planes I through XI indicated in FIG. 1, in which the elongate sheet metal portion has been omitted in the cross-sectional views of FIGS. 2*b*), 2*d*), 2*f*), 2*h*) and 2*j*), FIGS. 3*a*) 3*b*), 3*c*), 3*d*), and 3*e*) are enlarged diagrammatic cross-sectional views of the cross-sectional planes II, IV, VI, VIII and X indicated in FIG. 1.

FIG. 1 diagrammatically shows a perspective view of an embodiment of the production method according to the invention. An elongate sheet metal portion 6 which includes a flat surface 3 is processed in five method steps by shaping apparatuses in the form of profiling roll sets 10, 11, 12, 13 and 14. In this connection, a man skilled in the art in connection with processing by profiling rolls also uses the term "passes". In the illustrated case, the elongate sheet metal portion 6 is consequently processed in five successive passes. In that situation, the elongate sheet metal portion 6 is moved along its longitudinal direction 4 through the shaping apparatuses 10, 11, 12, 13 and 14. The direction of movement is identified by an arrow.

In the illustrated example, the elongate sheet metal portion 6 admittedly includes only one flat surface 3. However, in preferred embodiments, an elongate sheet metal portion which has already been partially shaped can be fed to the shaping apparatuses and/or the elongate sheet metal portion can be further shaped subsequently to the processing operation, and preferably bent.

At least one first and at least one further method step are required for carrying out the method. In the illustrated example, as already stated, five method steps are shown. Preferably, besides a first method step, between ten and fifteen further method steps take place. For the sake of simplicity, however, that preferred embodiment is not illustrated here.

Figures 2A, 2B, 2C, 2D, 2E, 2F, 2G, 2H, 2I, 2J, 2K:
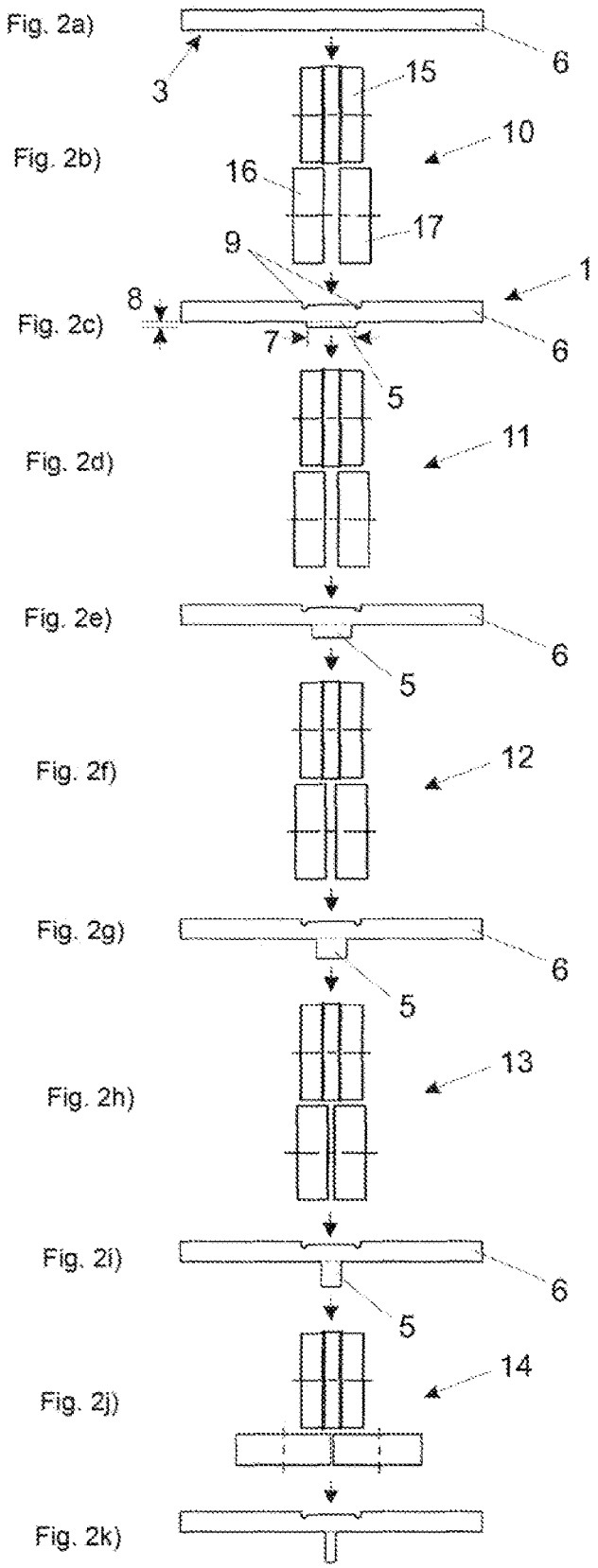
Figure 3A:
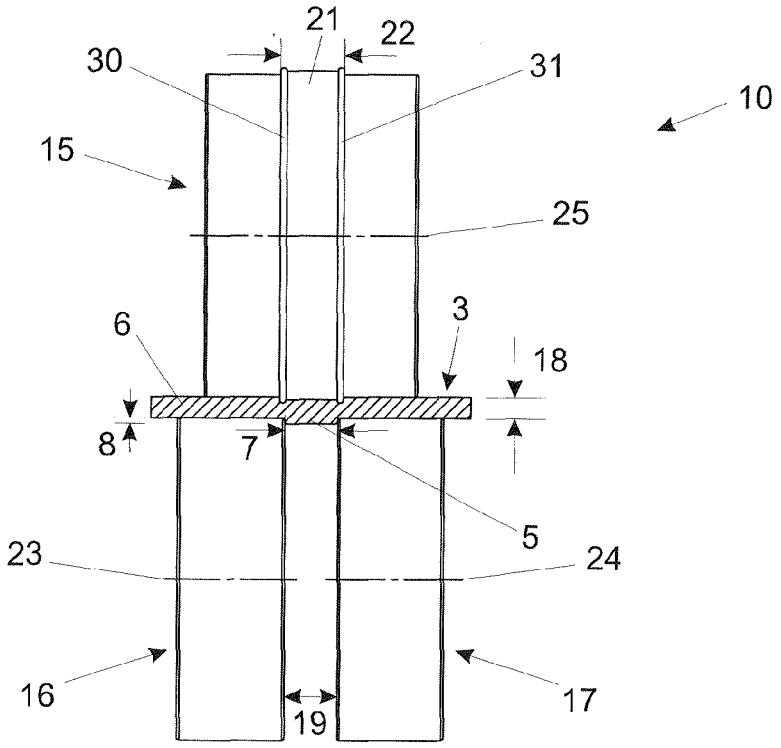
Figure 3B:
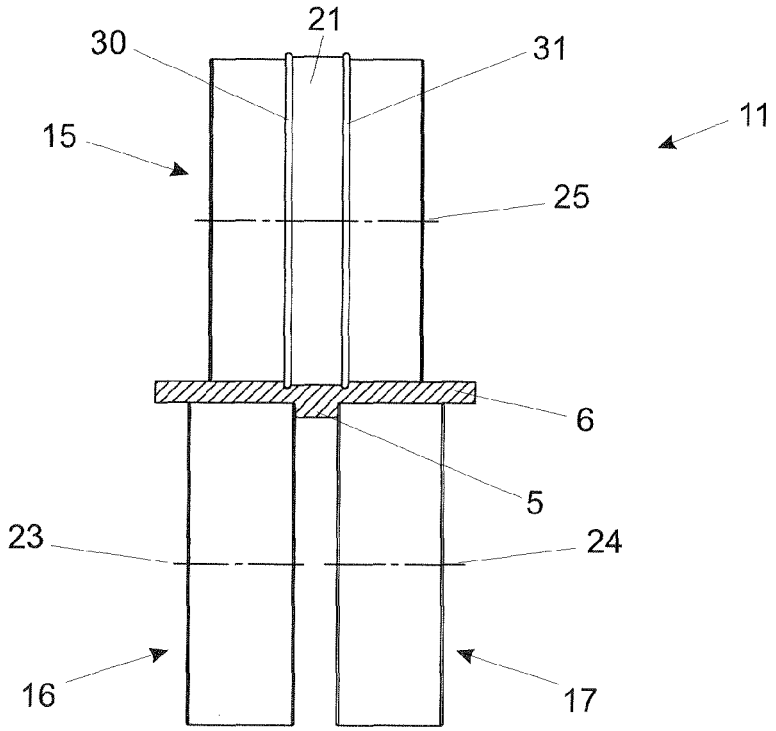
Figure 3C:
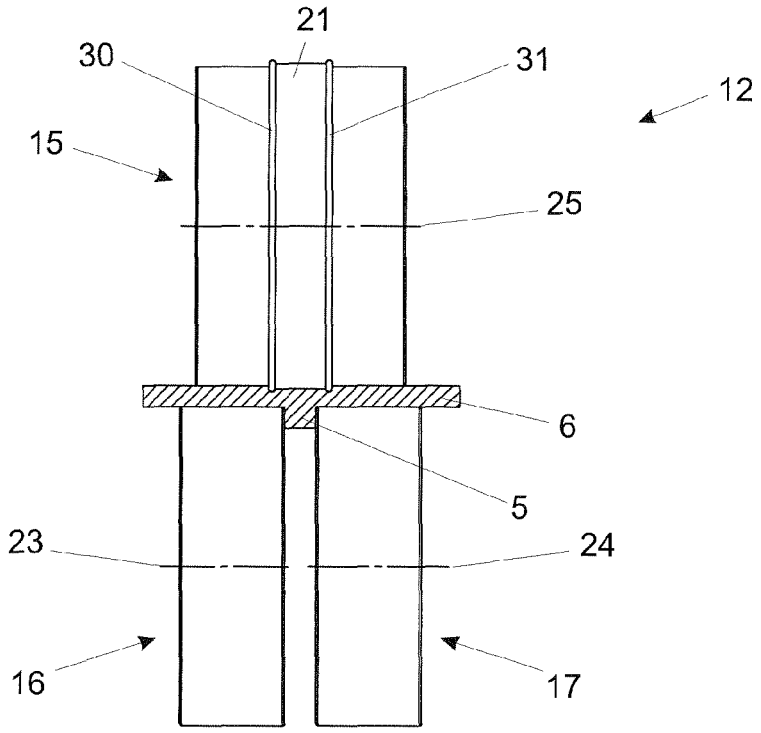
Figure 3D:
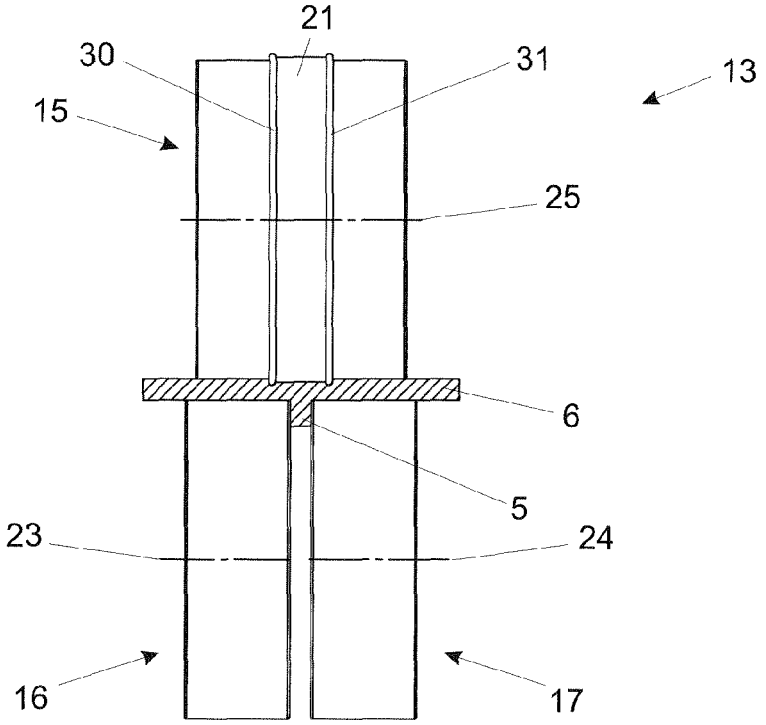

FIGS. 2*a*) through 2*k*) and FIGS. 3*a*) through 3*e*) serve to illustrate the individual method steps, and those Figures respectively show a given cross-section indicated by dash-dotted lines from the structure shown in FIG. 1.

To start with, the basic structure of the shaping apparatuses 10, 11, 12, 13 and 14 which are preferably used will also be briefly considered. Each of those shaping apparatuses 10, 11, 12, 13 and 14 includes a profiling roll set having a first (primary) profiling roll 15 and two further (secondary) profiling rolls 16 and 17. Each of those profiling rolls 15, 16 and 17 is substantially in the form of a cylinder having a peripheral surface 20, 26 and 27, respectively, and two end faces which in the case of the two further profiling rolls are denoted by reference numbers 28 and 29. Further details like, for example, the relative spatial arrangement of the profiling rolls 15, 16 and 17 with respect to each other will be discussed more fully in the course of the description of FIGS. 3*a*) through 3*e*).

The sequence of FIGS. 2*a*) through 2*k*) serves to illustrate the method steps shown in FIG. 1, wherein the Figures correspond in the alphabetical sequence to the cross-sectional planes in FIG. 1, identified by Roman numerals I through XI. In this regard, it is to be noted that the sheet metal profile 6 has been omitted from FIGS. 2*b*), 2*d*), 2*f*), 2*h*) and 2*j*) for the sake of simplicity. Those five cross-sectional views are described more fully with reference to FIGS. 3*a*) through 3*e*).

The starting point of the method is the elongate sheet metal portion 6 having at least one flat surface 3 (see FIG. 2*a*)). In a first method step, a web 5 which projects laterally, in this case perpendicularly, is squeezed out of the flat surface 3 of the elongate sheet metal portion 6. How that takes place in detail will be described with reference to FIG. 3*a*). By virtue of the fact that the elongate sheet metal portion 6 is moved relative to the shaping apparatus 10, the web 5 extends in the longitudinal direction 4 of the elongate sheet metal portion 6 (see FIG. 1).

After the first method step, the web 5 has a given shape which depends on the configuration of the shaping tools used in the first method step. In the illustrated embodiment (see FIG. 2*c*)), the web 5—considered in cross-section—has a substantially rectangular shape of a given width 7 and a given height 8.

The dimensions of that web 5 can now be modified in further method steps, more specifically by the web 5 being squeezed together, that is to say by being reduced in its width 7 and increased in its height 8 (see FIGS. 2*e*), 2*g*), 2*i*) and 2*k*)). Depending on the purpose that the web 5 is to achieve, the web 5 can in principle have any desired dimensions depending on the number of further method steps to be employed.

Advantageously, during the method steps, a return flow of the sheet metal material into the flat surface 3 of the elongate sheet metal portion 6 is inhibited by delimiting material incisions 9.

In general, it should also be pointed out that the method is carried out at ambient temperature, which is typically at a temperature of between 15° C. and 25° C. Furthermore, the elongate sheet metal portion is preferably advanced by an active drive of the profiling rolls 15, 16 and 17, for example at a speed of between 1 m/min and 300 m/min. In that respect, it is possible to conceive of both a continuous mode of operation and also a start-stop mode.

We now turn to FIGS. 3*a*) through 3*e*) which show in detail cross-sections along planes II, IV, VI, VIII and X in FIG. 1. The basic structure of the shaping apparatuses 10, 11, 12, 13 and 14 used in the five illustrated passes, as already stated, is the same in each case. Each of those shaping apparatuses 10, 11, 12, 13 and 14 includes a profiling roll set including a first (primary) profiling roll 15 and two further (secondary) profiling rolls 16 and 17. Between the first profiling roll 15 and the two further profiling rolls 16 and 17 is a first gap 18 of a gap width substantially corresponding to the material thickness of the elongate sheet metal portion 6. A second gap 19 is provided between the two further profiling rolls 16 and 17.

At its peripheral surface 20 (see FIG. 1), the first (primary) profiling roll 15 has an annular bulge 21 of a width 22. That annular bulge 21 on the first profiling roll 15 and the second gap 19 between the two further (secondary) profiling rolls 16 and 17 are disposed in mutually opposite relationship.

In the first four illustrated profiling roll sets 10, 11, 12 and 13 (see FIGS. 3*a*) through 3*d*)) the axes of rotation 23 and 24 of the two further profiling rolls 16 and 17 are coaxial and oriented parallel to the axis of rotation 25 of the first profiling roll 15. Thus, the first gap 18 is provided between the peripheral surfaces 26 and 27 of the two further (secondary) profiling rolls 16 and 17 and the peripheral surface 20 of the first (primary) profiling roll 15, and the second gap 19 is between the end faces 28 and 29 of the two further profiling rolls 16 and 17 (see also FIG. 1).

Figure 3E:
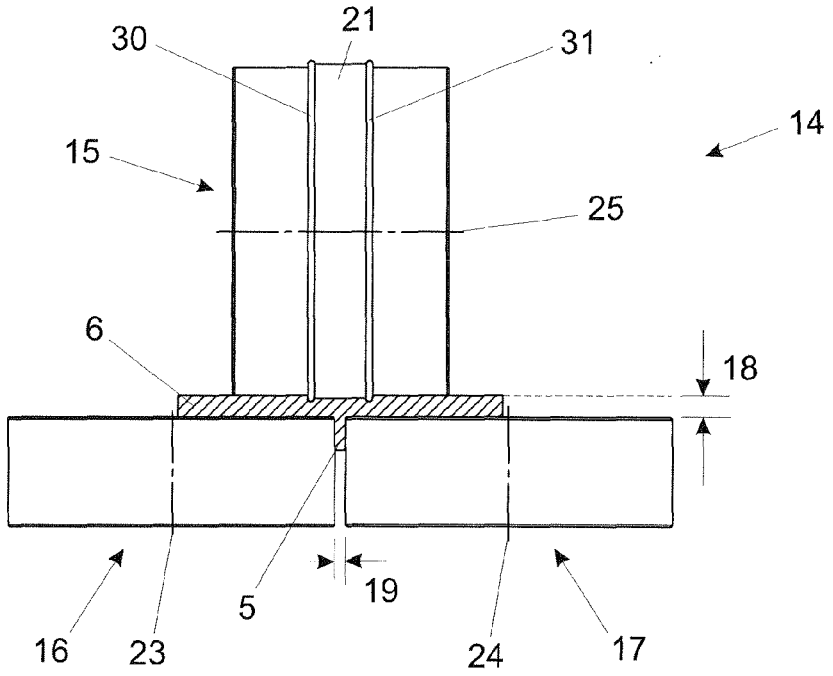

In the profiling roll set 14 shown in FIG. 3*e*), in comparison with the first four illustrated profiling roll sets 10, 11, 12 and 13, the axes of rotation 23 and 24 of the two further (secondary) profiling rolls 16 and 17 are oriented perpendicularly to the axis of rotation 25 of the first (primary) profiling roll 15 and at the same time parallel to each other. The first gap 18 is thus between the end faces 28 and 29 of the two further (secondary) profiling rolls 16 and 17 and the peripheral surface 20 of the first (primary) profiling roll 15 (see also FIG. 1). The second gap 19 is between the peripheral surfaces 26 and 27 of the two further profiling rolls 16 and 17.

The last-described arrangement of the profiling rolls 15, 16 and 17 relative to each other is preferably used at least in the last method step, particularly preferably from the third method step, as that arrangement of the profiling rolls 16 and 17 relative to the flat surface 3 of the elongate sheet metal portion 6 provides that a larger processing surface area is operative. In that way, the surfaces of the elongate sheet metal portion 6 that are adjacent to the squeeze-profiled web 5 can be smoothed in the concluding method step or steps.

Figure 7A:
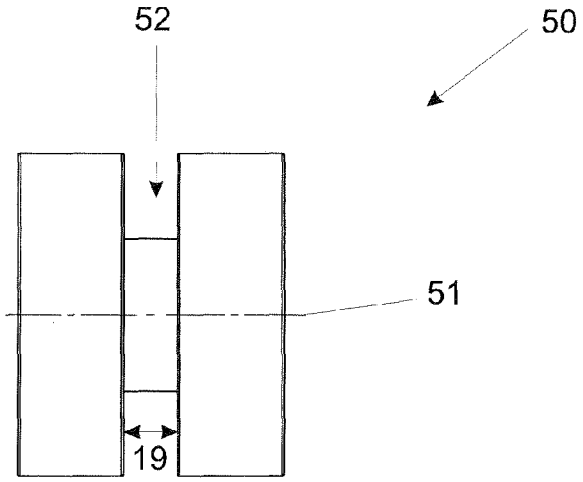
Figure 7B:
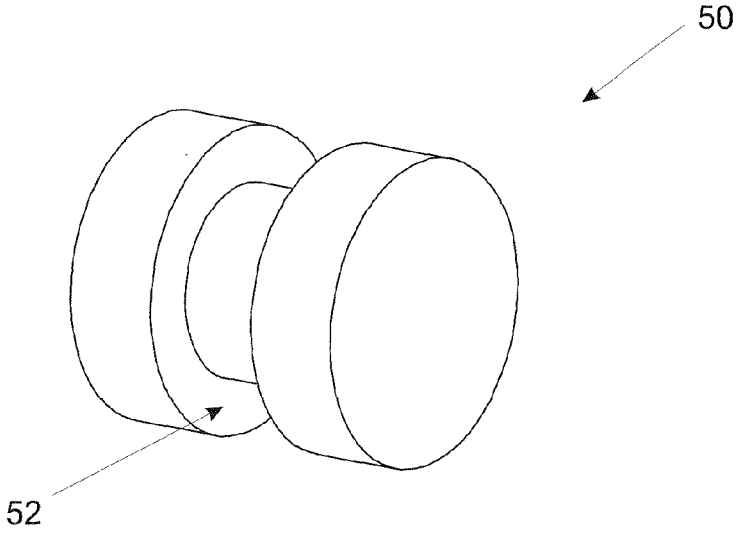

In a preferred alternate embodiment, instead of the two further (secondary) profiling rolls 16 and 17, only one secondary profiling roll 50 is used, and the profiling roll 50 has a channel-shaped recess 52 whose width corresponds to the gap width of the second gap 19 between the two further (secondary) profiling rolls 16 and 17 (see for example FIG. 3*a*)). That situation is shown in FIGS. 7*a*) and 7*b*), FIG. 7*a*) showing a cross-sectional view and FIG. 7*b*) showing a perspective view.

How now in detail is the web 5 squeezed out of the elongate sheet metal portion 6 in the course of the first method step? For that purpose, the elongate sheet metal portion 6 with the flat surface 3 is passed through the first gap 18 of the first profiling roll set 10 (see FIG. 3*a*)). In that situation, a web 5 is squeezed out of the flat surface 3 of the elongate sheet metal portion 6 and squeezed into the second gap 19 arranged between the two further profiling rolls 16 and 17 by the annular bulge 21 of the first profiling roll 15. That web 5 substantially corresponds in its dimensions (i.e., in its width 7 and in its height 8) to the dimensions of the annular bulge 21 of the first profiling roll 15.

The action already referred to above of inhibiting the return flow of the sheet metal material into the flat surface 3 of the elongate sheet metal portion 6 is implemented by the annular bulge 21 of the first profiling roll 15 being delimited by projections 30 and 31 which for example can be of a toroidal configuration. Material incisions 9 (see FIG. 2*c*))

are produced by those projections 30 and 31—considered in cross-section—to the right and the left of the squeezed-out web 5. The fact that the return flow of the sheet metal material during the method steps is inhibited, in the ideal case completely prevented, provides that the material volume of the web 5 remains almost constant.

To further alter the dimensions 7 and 8 of the web 5 formed in the course of the first method step, the elongate sheet metal portion 6, in further method steps, is passed through further profiling roll sets 11, 12, 13 and 14, and those profiling roll sets 11, 12, 13 and 14 each have a width for the second gap 19 that is reduced stepwise in relation to the preceding profiling roll set 10, 11, 12 and 13, respectively. In that way, the web 5 is positively squeezed together (i.e., the width 7 of the web 5 is reduced and at the same time its height 8 is increased). That can be seen by way of example by the succession of steps in FIGS. 3*a*) through 3*e*).

As already stated in the introductory part of the description sheet, metal profiles comprising, for example, steel can be produced for drawer extension guides by the production method according to the invention. For that purpose, prior to and/or following the squeeze formation of the at least one web 5, in the course of the first and the at least one further method step, the elongate sheet metal portion is transformed in shape, preferably bent, by further profiling rolls. Then, in a last method step, sheet metal profiles of a predetermined length are severed from a continuous elongate material portion or from an elongate material portion produced in a start-stop mode of operation.

Figure 4:
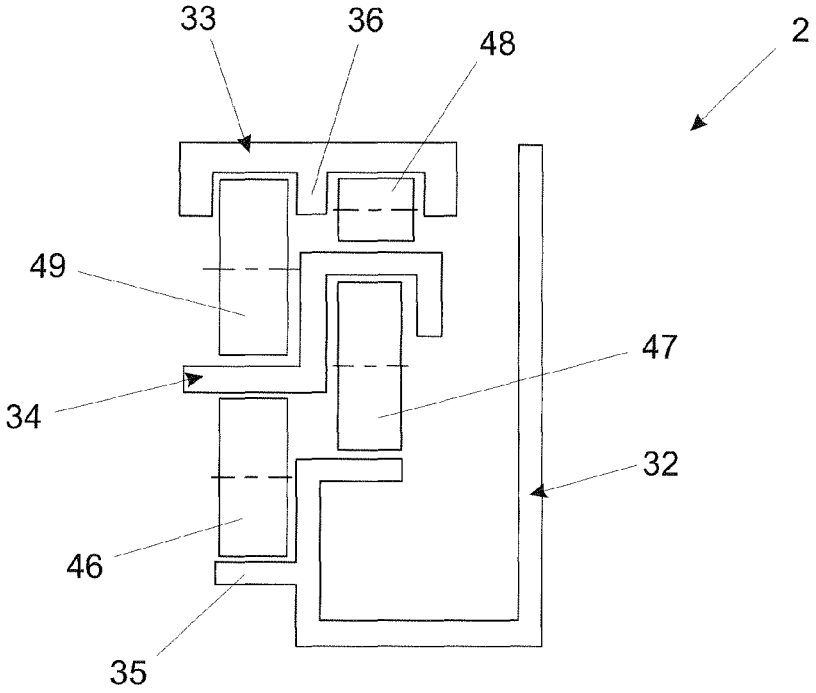
FIG. 4 shows a diagrammatically illustrated cross-section of a possible embodiment of a drawer extension guide, FIGS. 5*a*) and 5*b*) show an embodiment of a sheet metal profile according to the invention which can be used as a carcass rail in a drawer extension guide, with FIG. 5*a*) showing a perspective view and 5*b*) showing a cross-sectional view, FIGS. 6*a*) and 6*b*) show a further embodiment of the sheet metal profile according to the invention which can be used as a central rail in a drawer extension guide, with FIG. 6*a*) showing a perspective overall view and FIG. 6*b*) showing an enlarged view of a portion thereof, and FIGS. 7*a*) and 7*b*) show a profiling roll used in the method according to a preferred embodiment.

FIG. 4 shows by way of example in cross-section a possible drawer extension guide 2 which includes two sheet metal profiles 32 and 33 produced by an embodiment of the production method according to the invention. Such a drawer extension guide typically has a carcass rail 32 to be fixed to a furniture carcass, a drawer rail 33 to be fixed to the drawer and a central rail 34 mounted moveably between the carcass rail 32 and the drawer rail 33. Arranged between the rails 32, 33 and 34 are typically carriages with load-transmitting rolling bodies 46, 47 and 48, 49 which permit a relative movement of the rails 32, 33 and 34 with respect to each other.

In the illustrated embodiment, both the carcass rail 32 and also the drawer rail 33 include a web 35 and 36, respectively, which webs can be produced by the squeeze shaping operation described hereinbefore. In the case of the carcass rail 32 the rolling body 46 arranged between the central rail 34 and the carcass rail 32 runs on the web 35. In the case of the drawer rail 33, the web 36 serves to space the two rolling bodies 48 and 49 from each other and at the same time to provide a bearing for the rolling body 48.

Figure 5A:
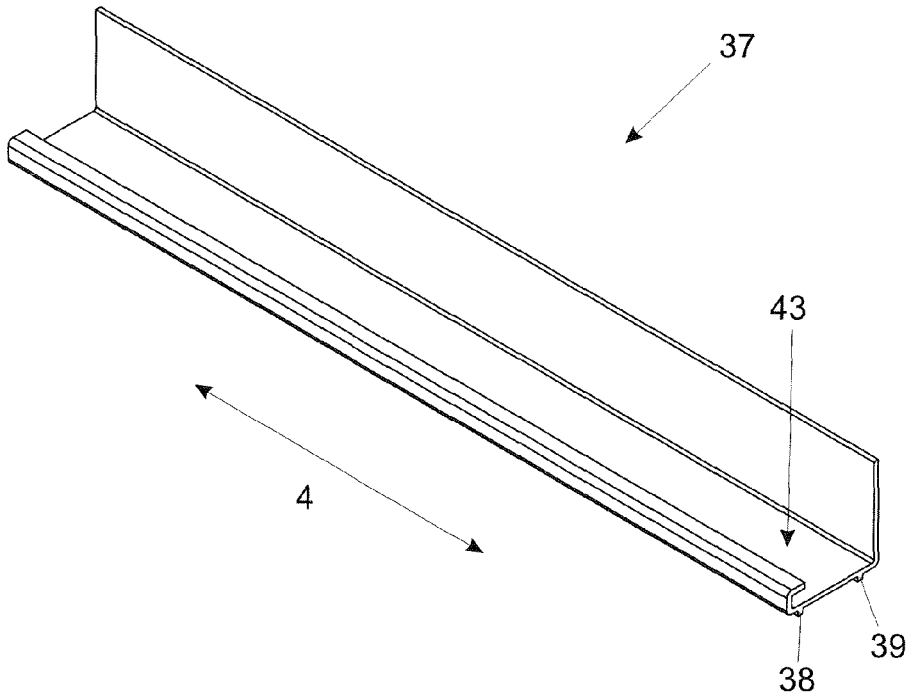
Figure 5B:
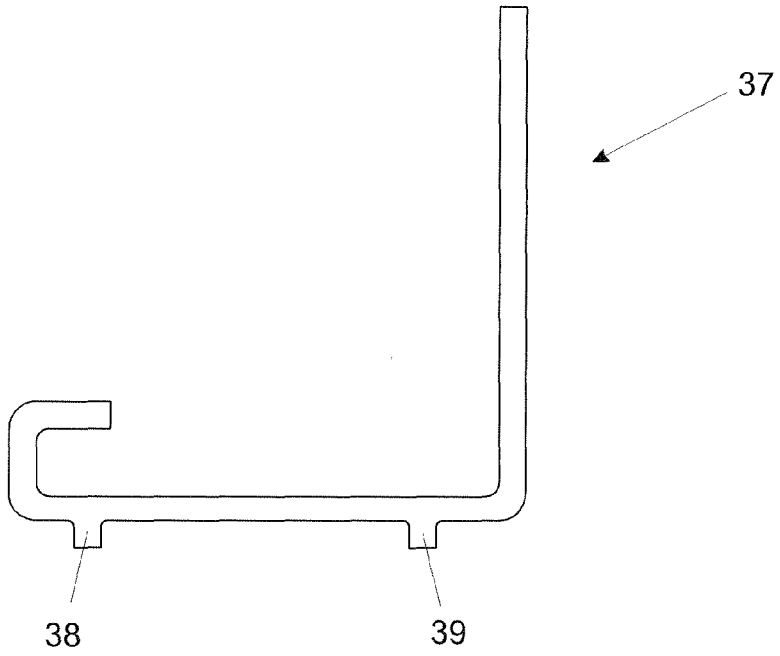

FIGS. 5*a*) and 5*b*) show a further example of a carcass rail 37, with FIG. 5*a*) showing a perspective view and FIG. 5*b*) showing a cross-sectional view of the carcass rail 37. Arranged on the flat surface 43 of the carcass rail 37 are two webs 38 and 39 which can be formed by the described squeeze profiling procedure. In this case they represent reinforcing ribs which serve to reinforce the carcass rail 37.

Figure 6A:
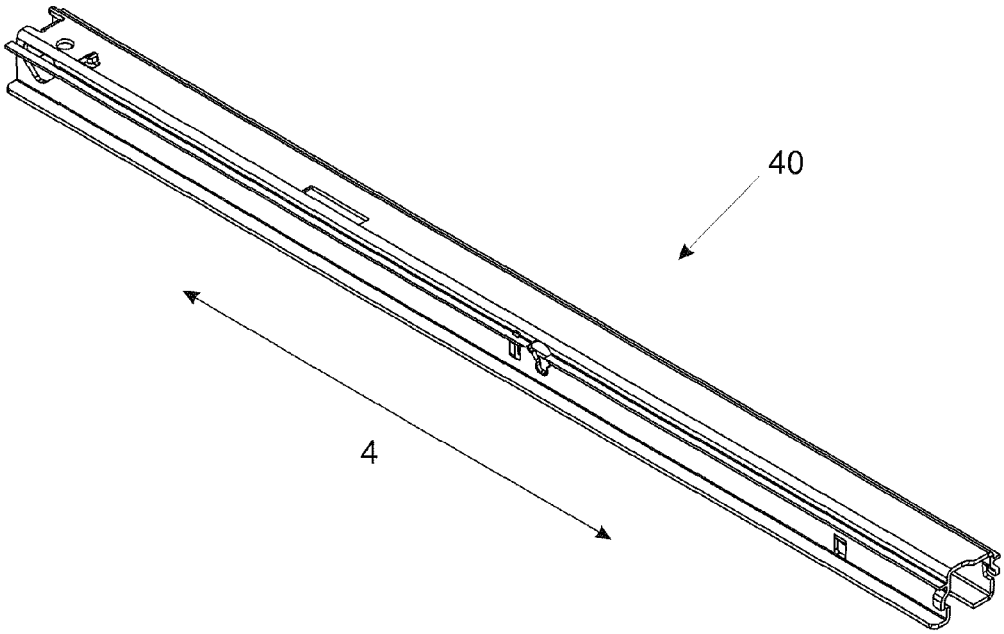
Figure 6B:
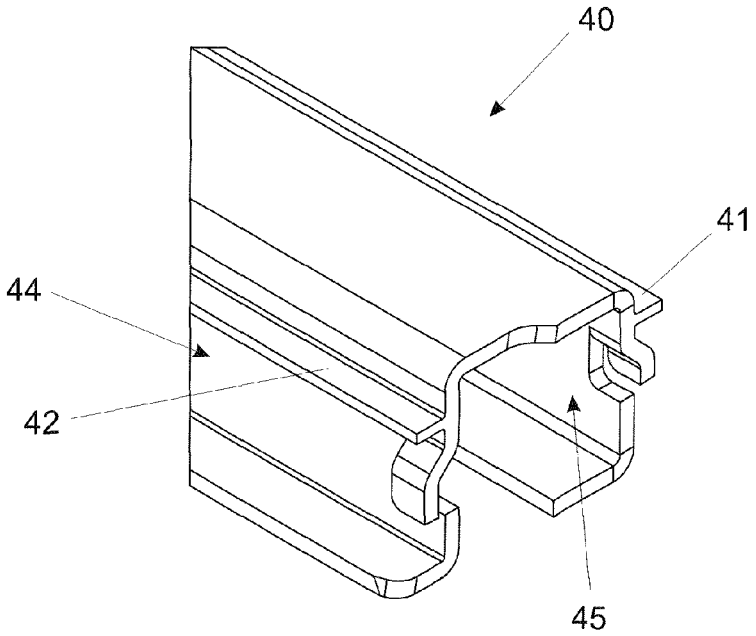

FIGS. 6*a*) and 6*b*) show by way of example a central rail 40 of a drawer extension guide, with FIG. 6*a*) showing a perspective overall view and FIG. 6*b*) showing a portion thereof. Considered in cross-section, the illustrated central rail 40 substantially comprises a U-shaped profile. Arranged at the two lateral mutually opposite limbs of that U-shaped profile are two squeeze-profiled webs 41 and 42 respectively, which project from the flat surfaces 44 and 45. The rolling bodies of a carriage (not shown) arranged between the central rail 40 and a drawer rail (also not shown) can run on those webs 41 and 42. The carriage engages under the webs 41 and 42 in the position of use of the extension guide with the rolling bodies thereof to secure it against being lifted off the central rail 40. In that way, if the central rail 40 is at the same time also secured to prevent it from lifting off the carcass rail, a tilting play in respect of the drawer that occurs in particular with a drawer which is completely pulled out, can be prevented.

Finally, it should be noted that the term "rolling body" is to be construed very broadly and can be for example in the form of a roll, a cylindrical roller or a ball. In that case, the rolling body can both include a spindle bearing and can also be guided spindle-less for example in a cage.

The invention claimed is:

1. A method for producing a sheet metal profile, said method comprising:

squeezing at least one flat surface of an elongate sheet metal portion to form at least one web projecting laterally with respect to the at least one flat surface and extending in a longitudinal direction of the elongate sheet metal portion;

subsequently squeezing the at least one web together so that the at least one web is reduced in width and increased in height; and repeating said subsequent squeezing of the at least one web using profiling roll sets to form the sheet metal profile, each of the profiling roll sets including:

at least one primary profiling roll; and at least two secondary profiling rolls;

wherein the at least one primary profiling roll and the at least two secondary profiling rolls being arranged to define a first gap between the at least one primary profiling roll and the at least two secondary profiling rolls, the first gap having a gap width corresponding to a material thickness of the elongate sheet metal portion so as to receive the elongate sheet metal portion, and to define a second gap between the at least two secondary profiling rolls, and wherein the at least one primary profiling roll has a peripheral surface with an annular bulge, and the annular bulge being arranged to oppose the second gap between the at least two secondary profiling rolls.

2. The method as set forth in claim 1, wherein, during at least one of said squeezing the at least one flat surface and said subsequent squeezing of the at least one web, delimiting material incisions are formed to inhibit a return flow of sheet metal material into the at least one flat surface of the elongate sheet metal portion.

3. The method as set forth in claim 1, wherein the method is performed at ambient temperature.

4. The method as set forth in claim 1, wherein, in at least one of the profiling roll sets:

the axes of rotation of the at least two secondary profiling rolls are oriented parallel to the axis of rotation of the at least one primary profiling roll, the first gap is arranged between the peripheral surfaces of the at least two secondary profiling rolls and the peripheral surface of the at least one primary profiling roll, and the second gap is disposed between end faces of the at least two secondary profiling rolls.

5. The method as set forth in claim 1, wherein, in at least one of the profiling roll sets:

the axes of rotation of the at least two secondary profiling rolls are oriented perpendicularly to the axis of rotation of the at least one primary profiling roll, the axes of rotation of the at least two secondary profiling rolls are oriented parallel to each other, the first gap is disposed between the end faces of the at least two secondary profiling rolls and the peripheral surface of the at least one primary profiling roll, and the second gap is disposed between the peripheral surfaces of the at least two secondary profiling rolls.

6. The method as set forth in claim 1, wherein, during said squeezing of the at least one flat surface, the at least one web is squeezed out of the at least one flat surface and squeezed into the second gap by a passage of the at least one flat surface of the elongate sheet metal portion through the first gap by the annular bulge of the at least one primary profiling roll, the at least one web having dimensions corresponding to dimensions of the annular bulge.

7. The method as set forth in claim 1, wherein, during said subsequent squeezing of the at least one web, the at least one web is further squeezed together by a passage of the elongate sheet metal portion through at least one profiling roll set having a second gap with a gap width reduced in comparison with a gap width of the second gap of a preceding profiling roll set with respect to a direction of movement of the elongate sheet metal portion.

8. The method as set forth in claim 1, wherein the annular bulge of the at least one primary profiling roll is delimited by toroidal projections, the toroidal projections inhibiting a return flow of the sheet metal material into the at least one flat surface of the elongate sheet metal portion during at least one of said squeezing the at least one flat surface and said subsequent squeezing of the at least one web.

9. The method as set forth in claim 1, wherein the elongate sheet metal portion is advanced by a drive of the at least one primary profiling roll and the at least two secondary profiling rolls of at least one of the profiling roll sets.

10. The method as set forth in claim 9, wherein the elongate sheet metal portion is advanced by the drive of the at least one primary profiling roll and the at least two secondary profiling rolls of at least one of the profiling roll sets at a speed of between 1 m/min and 300 m/min.

11. The method as set forth in claim 1, further comprising bending the elongate sheet metal portion by further profiling rolls.

12. The method as set forth in claim 1, further comprising, after said repeating of said subsequent squeezing of the at least one web, separating the sheet metal profile produced continuously or in a start-stop mode of operation from the elongate sheet metal portion into a plurality of sheet metal profiles having a predetermined length.

13. The method as set forth in claim 1, wherein the elongate sheet metal portion is formed of steel.

14. The method as set forth in claim 1, wherein the sheet metal profile is to form part of a drawer extension guide having at least one web projecting laterally.

15. The method as set forth in claim 1, wherein said repeating of said subsequent squeezing of the at least one web comprises subsequently squeezing the at least one web between 10 and 15 times to reduce the width and increase the height of the at least one web.

16. The method as set forth in claim 1, wherein, in at least a first profiling roll set with respect to a direction of movement of the elongate sheet metal portion:

the axes of rotation of the at least two secondary profiling rolls are oriented parallel to the axis of rotation of the at least one primary profiling roll, the first gap is arranged between the peripheral surfaces of the at least two secondary profiling rolls and the peripheral surface of the at least one primary profiling roll, and the second gap is disposed between end faces of the at least two secondary profiling rolls.

17. The method as set forth in claim 1, wherein, in each of at least a first two profiling roll sets with respect to a direction of movement of the elongate sheet metal portion:

the axes of rotation of the at least two secondary profiling rolls are oriented parallel to the axis of rotation of the at least one primary profiling roll, the first gap is arranged between the peripheral surfaces of the at least two secondary profiling rolls and the peripheral surface of the at least one primary profiling roll, and the second gap is disposed between end faces of the at least two secondary profiling rolls.

18. The method as set forth in claim 1, wherein, in at least a final one of the profiling roll sets with respect to a direction of movement of the elongate sheet metal portion:

the axes of rotation of the at least two secondary profiling rolls are oriented perpendicularly to the axis of rotation of the at least one primary profiling roll, the axes of rotation of the at least two secondary profiling rolls are oriented parallel to each other, the first gap is disposed between the end faces of the at least two secondary profiling rolls and the peripheral surface of the at least one primary profiling roll, and the second gap is disposed between the peripheral surfaces of the at least two secondary profiling rolls.

19. A method for producing a sheet metal profile, said method comprising:

squeezing at least one flat surface of an elongate sheet metal portion to form at least one web projecting laterally with respect to the at least one flat surface and extending in a longitudinal direction of the elongate sheet metal portion;

subsequently squeezing the at least one web together so that the at least one web is reduced in width and increased in height; and repeating said subsequent squeezing of the at least one web using profiling roll sets;

wherein at least one of the profiling roll sets includes:

at least one primary profiling roll; and at least two secondary profiling rolls;

wherein the at least one primary profiling roll and the at least two secondary profiling rolls being arranged to define a first gap between the at least one primary profiling roll and the at least two secondary profiling rolls, the first gap having a gap width corresponding to a material thickness of the elongate sheet metal portion so as to receive the elongate sheet metal portion, and to define a second gap between the at least two secondary profiling rolls, and wherein the at least one primary profiling roll has a peripheral surface with an annular bulge, and the annular bulge being arranged to oppose the second gap between the at least two secondary profiling rolls; and wherein at least one of the profiling roll sets includes:

at least one primary profiling roll; and a secondary profiling roll having a channel-shaped recess;

wherein the at least one primary profiling roll and the secondary profiling roll being arranged to define a first gap between the at least one primary profiling roll and the secondary profiling roll, the first gap having a gap width corresponding to a material thickness of the elongate sheet metal portion so as to receive the elongate sheet metal portion, and the channel-shaped recess having a width corresponding to a gap width of the second gap of the at least two secondary profiling rolls, and wherein the at least one primary profiling roll has a peripheral surface with an annular bulge, and the annular bulge being arranged to oppose the channel-shaped recess.

* * * * *